United States Patent [19]

Ericsson

[11] Patent Number: 4,802,410

[45] Date of Patent: Feb. 7, 1989

[54] SHEET GRIPPER ARRANGEMENT FOR SILK SCREEN PRINTER

[75] Inventor: Sylve J. D. Ericsson, Tumba, Sweden

[73] Assignee: Svecia Silkscreen Maskiner AB, Norsborg, Sweden

[21] Appl. No.: 58,272

[22] Filed: Jun. 4, 1987

[30] Foreign Application Priority Data

Jun. 5, 1986 [SE] Sweden ..... 86 02551
Apr. 1, 1987 [SE] Sweden ..... 87 01365

[51] Int. Cl.[4] ..... B41F 15/08; B41F 15/14

[52] U.S. Cl. ..... 101/124; 101/408; 271/268

[58] Field of Search ..... 101/124, 118, 126, 279, 101/408; 271/268, 85

[56] References Cited

U.S. PATENT DOCUMENTS 2,893,732 7/1959 Hauck ..... 271/268
4,031,824 6/1977 Bubley et al. ..... 271/268 X
4,193,344 3/1980 Ericsson ..... 101/126

FOREIGN PATENT DOCUMENTS 1367441 9/1974 United Kingdom ..... 101/124

*Primary Examiner*—Clifford D. Crowder
*Attorney, Agent, or Firm*—Burns, Doane, Swecker and Mathis

[57] ABSTRACT

A silk screen printer includes a cylindrical printing table for applying print to a sheet material and a stencil which is stretched in a frame. The stencil is adapted for reciprocating movement in response to reciprocating movement of the printing table and a squeege arrangement is included for urging the stencil towards the printing table to thereby transfer print onto sheet material located between the printing table and the stencil. A gripping device is provided for gripping the forward end of the material. The gripping device is movable with the frame in the direction of the longitudinal extent of the frame. A spring device urges the gripping device towards a movement-damping member whereby the gripping member is registered in relation to the chassis of the printer. The registration of the gripping device relative to the chassis is independent of the stop position of the frame and the printing table.

20 Claims, 1 Drawing Sheet

SHEET GRIPPER ARRANGEMENT FOR SILK SCREEN PRINTER

TECHNICAL FIELD

The present invention relates to a silk screen printer, and more particularly, although not exclusively, to a silk screen printer of the kind which incorporates a curved printing table, preferably a cylindrical printing table.

Silk screen printers which include a flat stencil frame or frame carriage and a cylindrical printing table are particularly suited for applying print to hard materials which are either totally inflexible or only slightly flexible.

It is known in this regard to stretch a stencil in a frame, or frame carriage, capable of being moved reciprocatingly in response to the reciprocating movement of the cylindrical printing table, and to provide a squeegee arrangement which will press the stencil against material to receive print located between the printing table and the stencil, therewith to transfer print onto the material.

It is known to provide in silk screen printers of this kind gripping means which hold the material firmly at its forwardly located end, as seen in the direction of movement, at least during a part of the printing sequence.

BACKGROUND PRIOR ART

The British Patent Specification No. 1,367,441 (corresponding to Swedish Patent Specification No. 370 901.) teaches a silk screen printer of the kind that comprises a printing table in the form of a reciprocatingly oscillatory drum and a reciprocatingly movable stencil frame, movement of the frame being synchronized with movement of the drum, and the stencil frame includng a frame portion on which sheet gripping means are fixedly mounted, the frame portion being pivotable relative to the stencil frame at the end portion remote from the gripping means and the gripping means being movable on movement of the drum along a path which coincides with or is located parallel with a tangent to the drum, the end of the stencil frame at the gripping means being guided on movement of the drum along guide means which diverge from the path of the gripping means away from the drum.

It is recommended in a silk screen printer of this kind that the gripping means is fixedly mounted on a frame member of the frame chassis and that the frame and frame chassis are pivotally connected together at the part which faces away from the gripping means, and that the part of the frame located adjacent the gripping means extends along a guide rail which is directed so that the end of the frame part will continually move away from the frame chassis during the printing stage.

The present invention can be said to constitute a development of the silk screen printer described in the aforesaid British Patent Specification.

SUMMARY OF THE PRESENT INVENTION

A well known problem encountered with silk screen printers, and then particularly with silk screen printers of the kind which include cylindrical printing tables arranged for oscillatory reciprocating movement (stop cylinder printers), is one of ensuring that the printing table and the stencil frame will return to and stop in one and the same position, a registered position, in which gripping means located on the frame is or are able to grip a sheet of material which has been registered in the printer and which is intended to receive print.

Since the oscillatory energy of the cylindrical printing table becomes high as the printing table oscillates backwards and forwards, and since the mass of the frame also contributes positively to this oscillatory energy, it will be seen that difficulties may be encountered in ensuring that the printing table and the frame will stop precisely in a pre-determined, precise position. Naturally, the oscillatory energy to be mastered will become progressively greater the greater the speed permitted, therewith making it more difficult to stop the printing table and stencil frame in one and the same registered position. An even more complicated technical problem is one of being able to provide means whereby registration of the printing table and the stencil frame can be achieved in precisely one and the same registering position, irrespective of the prevailing printing speed.

Since, in order to achieve a high degree of accuracy when printing in silk screen printers, it is a prerequisite that the gripping means and the printing table take one and the same position at the beginning of each printing sequence, one prominent technical problem resides in the provision of conditions which will enable the gripping means to take precisely a pre-determined position in relation, inter alia, to the chassis of a silk screen printer, without taking into account the stop position of the stencil frame and the printing table, irrespective of the large oscillatory mass and the high kinetic energy of the printing table and the stencil frame, the motion of which shall be stopped immediately.

When a non-registered position is permitted between the gripping means and the stencil frame, when the gripping means are intended to grip a sheet of material to receive print, a further technical problem resides in the possibility of realigning or re-registering the gripping means with the stencil frame during the printing stage, with the aid of simple means herefor.

Another technical problem is one creating, with the aid of simple means, conditions which will enable the set position of the gripping means in relation to the frame and the stencil to be modified or adjusted and to enable this position to be modified through a plurality of printing sequences.

It will be seen that a further technical problem in this regard resides in the provision of means which will enable the gripping means to be registered in their correct positions without needing to take large oscillating masses and high kinetic energies into account, or at least to only a small extent.

When considering the present state of the art and the technical problems encountered with silk screen printers of this kind it will be seen that one qualified technical problem is associated with the realization that the precision required can be actually achieved by firstly stopping solely the gripping means in a precise, registered position and causing said means to grip the material sheet in said position, while permitting the stencil and stencil frame to stop in a non-registered position over a commensurately longer reaction time and, when returning the stencil and printing table to the printing position, secondly by first bringing the stencil to a registered position relative to the gripping means prior to commencing the actual printing operation.

A prominent technical problem in the present context is one of providing conditions which will enable the gripping means to be brought to a registered position despite the presence of large oscillating masses and high kinetic energies, by stopping solely the gripping means and their associated attachment means in a registered position in relation to the chassis of the silk screen printer or some other reference point.

Another technical problem resides in realizing the possibility of and the provision of conditions for arranging the gripping means "loosely" in relation to the printing table and the stencil frame, in a manner which will enable solely the gripping means to be brought to a registered position, i.e. to hold the gripping means in a precise location irrespective of the position of the stencil while registering the gripping means, or of the moment at which the gripping means grips the material sheet, and still enable the gripping means, the sheet material to receive print, and the stencil to be brought to an exact, registered position in relation to one another during the whole of the printing sequence with the aid of simple means herefor.

It will be appreciated that in the case of silk screen printers of this kind a highly qualified problem resides in the conception of first registering the position of the gripping means in relation to the chassis or some other suitable reference point; causing the gripping means to grip the material sheet in register therewith while in said registered position; moving the stencil frame to a registered position relative to the gripping means, while the gripping means and said material are registered relative to the chassis; moving the gripping means and the material forwards for printing purposes; and maintaining the stencil and the material in said registered position during the whole of the printing sequence.

The present invention relates to a silk screen printer and more specifically, although not exclusively, to a silk screen printer of the kind which has a curved printing table, preferably a cylindrical printing table, and which is adapted to apply print to a material sheet, and in which printer a stencil stretched in a stencil frame is arranged to move backwards and forwards over the printing table synchronously with the reciprocating oscillatory movement of said table, and in which there is provided a squeegee arrangement effective in urging the stencil towards the printing table, therewith to transfer print to material located between the printing table and the stencil.

The frame is intended to co-operate with gripping means which grip the material at its forward end, as seen in the direction of movement, during at least part of the printing sequence.

For the purpose of solving one or more of the aforesaid problems it is proposed in accordance with the present invention to arrange the gripping means in the frame for horizontal movement in a direction conforming to a longitudinal extension or movement direction of the frame, and that the gripping means is/are capable of being pressed against a first stop means by a spring device. The spring device exerts a force in the horizontal direction and is operative in urging the gripping means against a second stop means which co-acts with the stencil frame.

It is also proposed in accordance with the invention that the position of the first stop means can be adjusted so as to enable the position of the gripping means in relation to the chassis or some other suitable reference point to be adjusted, and that the gripping means is/are arranged to co-act with a shoulder or the like capable of being urged towards the first stop means by a spring-loaded piston device.

The piston device is reciprocatingly movable in a guide mounted on the frame. The frame also has provided thereon an anvil surface for the spring. The spring is intended to urge the gripping means against the second stop means during a printing sequence when the gripping means occupies or occupy a registered position in relation to the stencil frame and the stencil.

In accordance with one advantageous embodiment of the invention the first stop means is fixed in relation to the printer chassis or printer stand.

To enable the oscillating and moving masses of high kinetic energy to be stopped substantially independently of the requirement of good registration of the gripping means, and in order to permit longer retardation times without reducing printing speeds, it is proposed in accordance with one advantageous embodiment of the invention that the printing table and the stencil frame are arranged to travel beyond the intended registered position of the gripping means while leaving solely the gripping means for registration in said position.

In order to take-up the kinetic energy of solely the gripping means in a smooth and gentle manner, it is proposed in accordance with a further modification of the invention that the first stop means is given the form of a movement damping device having a clearly defined terminal position, such as a hydraulic damping device or the like.

An advantage is obtained when the gripping means is/are firmly connected to a gripping means attachment which has two end parts, via a flexible element, and by arranging each of said two end parts of the attachment to coact with a respective first stop means for damping the movement of said attachment.

The aforesaid attachment conveniently includes two rods, one on each side thereof, each of which rods is slideable in a respective bushing located on mutually opposite chassis members and each presents movement-impeding second stop means which define a pre-determined setting between the stencil, the frame and the gripping-means attachment and the gripping means.

The hydraulic first stop or damping means is fixedly mounted relative to a guide means which is firmly connected to the chassis of the printer.

In accordance with a further embodiment of the invention, the material-gripping forward end of the gripping means is arranged to lie in a sunken or lowered position when the gripping means occupies its registered position.

The arrangement may conveniently include a spring device which urges the gripping means against an upper stop means in a horizontal position, and the arrangement may conveniently include a curved element, or camming element by means of which the forward end of the gripping means is brought into a material engaging position against the action of said spring device, upon movement of the gripping means towards its/their registered position.

Those advantages primarily afforded by a silk screen printer constructed in accordance with the present invention reside in the possibility of registering the gripping means in relation to the printer chassis or to some other suitable reference point while overcoming the kinetic energy of said device, and of refraining from registering the stencil with the stencil frame and printing table in this position until the commencement of a printing sequence, whereupon the stencil is moved to a registered position in relation to the gripping means and printing of the material held by said gripping means is commenced.

This possibility is achieved by constructing the gripping means attachment for movement in a horizontal direction and by enabling solely the gripping means to be located in a pre-determined registered position in relation to the registered position of the material to receive print, independently of the position of the stencil, without needing to pay too much attention to the in-exactitude caused by the retardation of heavy moving masses and their associated kinetic energies.

BRIEF DESCRIPTION OF THE DRAWINGS

An exemplary embodiment of the present invention will now be described in more detail with reference to the accompanying schematic drawings, in which.

DESCRIPTION OF PREFERRED EMBODIMENTS

Figure 1:
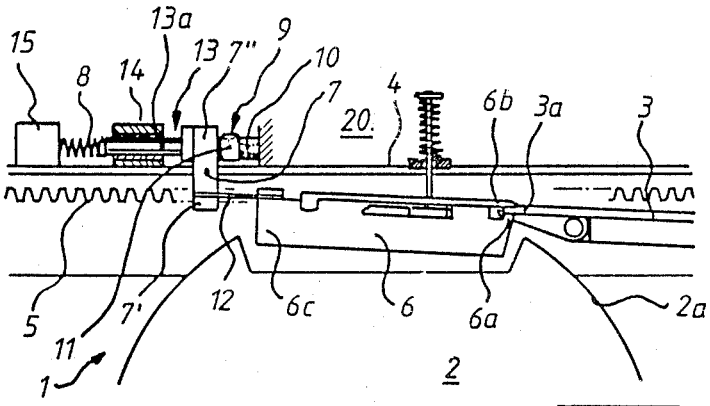
FIG. 1 is a simplified side view of a first embodiment of the gripping-means attachment in the frame.

The drawings illustrate part of a silk screen printer 1 having a curved printing table 2 which presents a cylindrical, curved printing surface 2*a*, and which printer is intended to apply print to a sheet of material 3. A stencil (not shown) is stretched in a stencil frame 4 in a manner known per se. The frame 4 is arranged for horizontal reciprocating movement in response to the reciprocating, oscillatory movement of the printing table 2, in that the frame co-acts with a rack 5 which, in turn, co-acts with a toothed ring (not shown) extending around the periphery of the printing table 2.

Although not shown, the illustrated silk screen printer includes a squeegee arrangement for pressing the stencil (not shown) against the material 3 and the printing table 2 in a manner known per se, therewith to transfer print onto said material located between the printing table and the stencil. The frame 4 co-acts with a gripping means 6 which is intended to grip the material 3 at its forwardly located end part 3*a*, as seen in the direction of movement, at least during a part of the printing sequence, but preferably during the whole of said sequence.

Since the squeegee arrangement, the reciprocating frame drive means, the printing table drive means, and all other functions for driving and operating the silk screen printer are known per se, such means and functions have not been described in this document for the sake of simplicity.

It should be mentioned for the sake of clarity, however, that during the printing sequence the squeegee arrangement is arranged to urge the stencil towards the material and printing table at the uppermost point of said table progressively, as the material 3 is displaced to the left in FIG. 1 by the gripping means 6.

In accordance with the present invention, the gripping means 6 is arranged for horizontal movement in the frame 4. This is effected by providing the gripping means or gripping-means attachment with pins or studs which run in tracks in corresponding frame parts.

Horizontal movement of the gripping means in the frame, however, can be achieved with the aid of other devices, as described in more detail hereinafter with reference to FIGS. 2 and 3. This enables the gripping means 6 to be moved axially to some extent in the frame, in a direction conforming with the longitudinal extension or movement direction of the frame.

In the illustrated embodiment, the gripping means 6 co-acts with a reference point comprising a first stop means 9 mounted on the chassis of the printer, although it will be understood that some other reference point may also be chosen.

The frame 4 and the printing table 2 can now be moved further to the right as seen in the drawing, without changing the position of the gripping means 6 in relation to the first stop means 9, while compressing the illustrated spring device 8.

It is now possible to stop the frame 4 and the printing table 2 without taking into account the desired precise registration of the gripping means 6, provided that the printing table and the frame 4 pass the position illustrated in FIG. 1. Registration of the gripping means 6 in relation to the chassis, via the first stop means 9, is totally independent of the prevailing stop position of the frame (stencil) and printing table.

If the frame 4 is permitted to pass further to the right than is illustrated in FIG. 1, the frame 4 and the stencil stretched therein will be located in a non-registered position in relation to the gripping means 6, the material 3 and the chassis.

The gripping means 6 incorporates a plurality of anvil surfaces 6*a* and a plurality of upwardly and downwardly movable gripping fingers 6*b* which, when the gripping means occupy the illustrated registered position, are intended to firmly grip the forward end part 3*a* of a sheet of material 3 in its registered position.

The forward part 6c of the gripping means 6, as seen in the direction of movement during a printing sequence, coacts with a lower part 7′ of a vertically and upwardly extending shoulder 7, via a bendable or flexible element 12. The upper part 7″ of the shoulder 7 is arranged to co-act with a piston and the aforesaid spring device 8, which device, when the frame 4 and the printing table 2*a* have moved beyond the registered position of the gripping means 6, is compressed by the shoulder 7, with the shoulder 7 and the gripping means 6 in a registered position against the first stop means 9, relative to the chassis 20 of the silk screen printer.

When the stencil and the frame 4 are located in this forwardly displaced position, to the right as seen in the drawing, they are out of register with the chassis 20.

Figure 3:
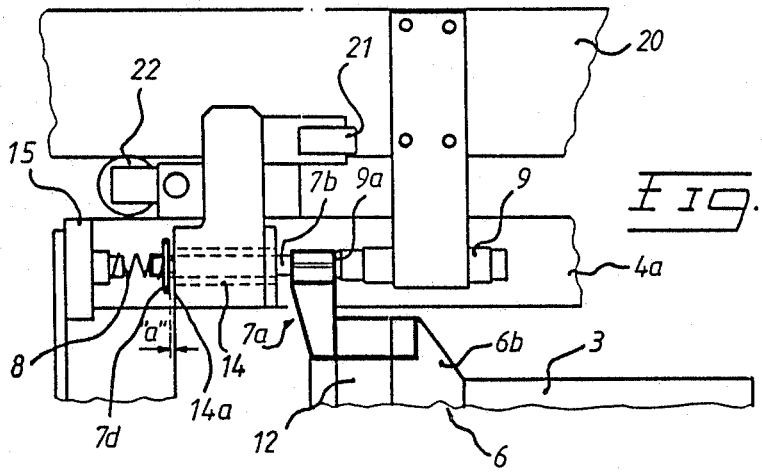
FIG. 3 is a horizontal view of part of the embodiment illustrated in FIG. 2.

When the stencil returns, it moves relative to the gripping means 6 against a second stop means thereby reducing the distance "a" as seen in FIG. 3, so the surface 14*a* will abut a collar 7*d*. Thus, the stencil moves to a position in which the stencil is registered in relation to the gripping means 6, whereupon printing can commence with the gripping means 6 and the stencil, or stencil frame, in mutually registered positions.

The second stop means is active between a piston rod 13a and a bushing 14, and also in relation to the stencil and the stencil frame 4 when the gripping means occupies a registered position.

The position of the first stop means 9, and therewith also the registered position of the gripping means 6, can be adjusted with the aid of a screw-threaded peg 10 which co-acts with an internally screw-threaded sleeve 11.

The piston 13 is guided for horizontal, reciprocating movement in a suitable guide or bushing 14 mounted on the frame 4 in a known manner. The frame 4 also carries an anvil or reaction surface 15 for the spring 8.

The piston 13 may be provided with means (a second stop means as exemplarily shown by elements *7d* and *14a* in FIG. 3) for bringing the piston to the position illustrated in the Figure without supporting against the first stop means 9, so that the piston is locked in the illustrated position against further movement to the right in FIG. 1.

The printing table 2 and the frame 4 are thus permitted to pass somewhat beyond the registered position of the gripping means 6, which takes its registered position relative to the chassis, suitably so as to grip and collect a registered sheet of material 3 for a subsequent printing sequence.

As previously mentioned, the registered position of the gripping means 6 can be adjusted by commensurate adjustment of the first stop means 9, this adjustment being made to suit a plurality of printing sequences.

In order to explain further technical concepts associated with the present invention, it can be mentioned that in the case of silk screen printers of this kind the frame, together with the stencil, is moved backwards and forwards in response to the reciprocating movement of the printing table, which therewith defines the speed at which printing is carried out.

The difficulties encountered in stopping these large oscillatory masses with their associated high kinetic energies in precisely one and the same terminal position, irrespective of the speed at which printing is carried out, will be obvious to those skilled in this art.

These difficulties are overcome, in accordance with the invention, by registering solely the material 3 in relation to solely the gripping means 6, which then become independent of the orientation of the stencil and the printing table in said terminal positions, and therewith ignore the inexactitudes caused by the large oscillatory masses in the stop positions.

In accordance with the invention the gripping means 6 is therefore mounted loosely in the frame, but pressed against a stop means in said frame, therewith enabling the gripping means, when moving to the right in the Figure, to stop against a first stop means 9 which is fixed in relation to the printer stand or chassis, and to grip in this registered position a sheet of material 3 also registered in this position, while the frame 4 and the printing table or cylinder 2 are able to move, and should continue to move, further to the right in FIG. 1, while compressing the spring 8, with the gripping means remaining in its registered position, due to the looseness of its attachment.

When the frame 4 and the printing table 2 are to move in the opposite direction, during the printing sequence movement occurs initially between the printing table 2 and the stencil in said frame 4 and the gripping means 6, but when the gripping means 6 has been displaced to its correct, registered position in relation to the frame 4 and the stencil, the gripping means will accompany movement of the frame as a result of co-action with the second stop means, as illustrated by example in FIG. 3.

This means that when collecting or gripping a sheet of material 3, the gripping means 6 is registered by the stop means 9 in relation to the printer chassis or stand, irrespective of the relative positions of the frame 4 and the printing table 2, while during the printing process the gripping means 6 is initially registered in relation to the frame 4 whereupon the printing process is commenced with the gripping means, the frame 4, and the stencil in their correct relative positions.

Figure 2:
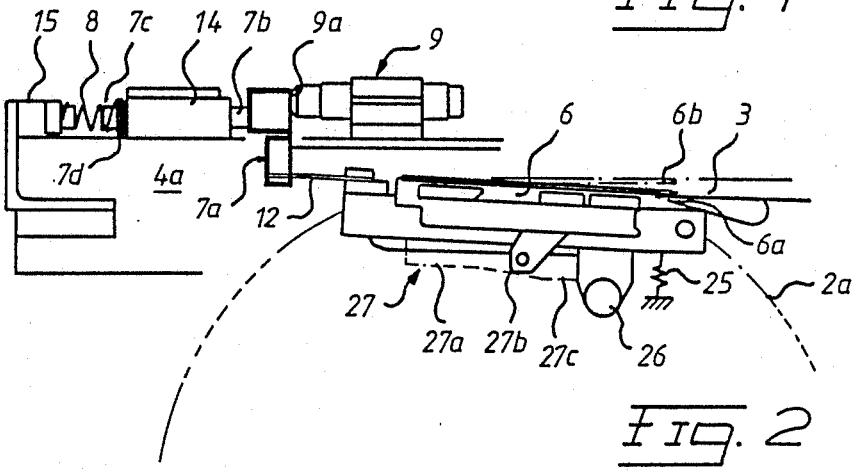
FIG. 2 is a simplified side view of a second embodiment of the gripping-means attachment in the frame, with the gripping means being shown in a registered position, this second embodiment incorporating a movement-damping stop means.

FIGS. 2 and 3 illustrate an alternative embodiment of an arrangement in silk screen printers constructed in accordance with the invention.

For the sake of simplicity those parts of the FIG. 1 embodiment corresponding with the embodiment illustrated in FIGS. 2 and 3 have been identified by the same reference nuemrals.

In this alternative embodiment, the first stop means 9 has the form of a movement damping device for damping movement of the gripping means 6 and the gripping-means attachment 7.

The movement damping device 9 is modified to form a well defined terminal position (a first stop position) for the gripping means 6, in which position the gripping means 6 is urged against the first stop means by the spring force exerted by the spring 8.

The gripping means 6 is firmly connected to a vertical, elongated gripping-means attachment 7a via a flexible element 12, made of spring steel, and the two mutually opposite end parts of the attachment 7a are arranged to co-act equally with a respective movement-damping stop means 9, of which only one is shown in FIGS. 2 and 3.

The hydraulic movement-damping stop means 9 is fixedly connected to a guide beam 20, which in turn is fixedly connected to the chassis of the silk screen printer.

The two end parts of the gripping means attachment *7a* are mutually identical, only one such end part, *4a*, being shown in FIG. 3.

It will be seen herefrom that the gripping-means attachment *7a* incorporates a rod *7b* arranged for axial sliding movement in a bushing 14 mounted on one part of the frame.

The bushing 14 co-acts with two support rollers 21 and 22, for guiding the frame, or frame carriage 4, along the guide beam 20.

The frame part *4a* of the frame carriage 4 has mounted thereon a support device 15 which holds the spring 8 for co-action with the free end *7c* of the rod *7b*. FIGS. 2 and 3 illustrate the first stop means 9 in a gripping-means registering position. The spring 8 urges the gripping means attachment *7a* against the first stop means 9.

It will be apparent that when the gripping means attachment *7a* is out of engagement with the first stop means 9, the free surface *9a* of the stop means will extend further to the left than is shown in FIGS. 2 and 3.

One pre-requisite of the function of the present invention is that movement of the frame 4, the gripping means 6, the gripping means attachment *7a* and the printing table *2a* to the right in FIGS. 2 and 3 can be effected in a manner such that the frame 4 and the printing table 2 can be displaced further to the right than the gripping means attachment 6. This is illustrated in FIGS. 2 and 3 by the spacing "a" between the surface *14a* of the bushing 14 and a collar *7d* mounted on one end of the rod *7b*.

In this illustrated position, the gripping means 6 and the gripping-means attachment *7a*, together with material 3 gripped in a registered position relative to the chassis, occupy a registered position to the chassis of the printer, whereas the frame 4, the stencil, and the printing table 2 are located in a position which is not registered in this respect.

Thus, when commencing a printing sequence and the printing table 2a and the frame 4 are moved to the left in the Figure, the frame will move initially without causing a change in the position of the gripping means 6 relative to the chassis. The spacing "a" decreases to zero.

The collar 7d will then engage the surface 14a of the busing 14, therewith to clearly define the positions of the frame 4 and the stencil in relation to the chassis. The gripping means 6 and the stencil frame 4 are now unambiguously set in relation to each other and in relation to the chassis, and the material is printed upon combined movement to the left as seen in the Figure.

Upon completion of the printing operation, the gripping means 6, the frame 4 and the printing table 2a are again moved to the right in the Figure, to the position illustrated therein, whereupon the gripping means 6 again engages the first stop means 9 and is stopped in a registered position, whereas the frame 4 and the printing table 2a pass beyond this position and stop in the illustrated position, or an adjacent position, with no precision requirements.

In FIG. 2 the material-gripping forward end-part 6a, 6b of the gripping means 6 is shown to be lowered from the horizontal, i.e., sunken, in the registered position of the gripping means.

This is effected with the aid of a spring 25 which acts on the end part 6a, 6b of the gripping means in a manner to urge said end part upwards into engagement with a stop means (not shown in the Figure) so as to take a horizontal position. The spring 25 can be attached to any suitable portion of the printer so long as it serves the function of continually urging the forward end of the gripping means upward. When the gripping means 6 moves from the left in FIG. 2 to the position illustrated therein, a guide roller 26 co-acts with a curved element 27, or camming surface, which comprises a horizontal initial part 27a and a lowered central part 27b which merges with said horizontal part 27a, in a manner to force the forward end part 6a, 6b of the gripping means 6 downwards away from the horizontal plane. The camming surface is terminated with a further horizontal part 27c.

Actuation of the parts 6a and 6b is effected in a known manner and will not therefore be described in detail.

The gripping means 6 is lowered in its registered position in order to facilitate gripping of the material to receive print.

It will be understood that the invention is not restricted to the aforedescribed and illustrated embodiments thereof, and that modifications can be made within the scope of the following claims.

I claim:

1. A silk screen printer comprising:

a substantially cylindrical printing table adapted to apply print to a sheet of material;

a stencil stretched in a movably mounted frame and arranged above the printing table;

a squeegee arrangement for urging the stencil against the printing table and to thereby transfer print onto said sheet of material located between the printing table and the stencil;

gripping means for gripping a forwardly located end part of said material, as seen in the direction of movement, during at least a part of the printing operation, said gripping means being mounted for movement with the frame in a direction along the longitudinal extent of the frame;

a spring device for urging said gripping means against a first stop means, said spring device being mounted for movement with said frame.

2. A printer according to claim 1, wherein said first stop means is adjustably mounted so that its position can be varied.

3. A printer according to claim 2, wherein said gripping means is connected to a shoulder which is capable of being urged towards said first stop means in response to a force exerted by said spring device on a piston.

4. A printer according to claim 3, further comprising a guide mounted on said frame, said piston being slidably movable in said guide.

5. A printer according to claim 1, wherein said gripping means is connected to a shoulder which is capable of being urged towards said first stop means in response to a force exerted by said spring device on a piston.

6. A printer according to claim 5, further comprising a guide mounted on said frame, said piston being slidably movable in said guide.

7. A printer according to claim 6, further comprising a support device mounted on said frame for resisting the force of said spring device.

8. A printer according to claim 5, further comprising a support device mounted on said frame for resisting the force of said spring device.

9. A printer according to claim 1, further comprising a chassis, said first stop means being fixedly mounted on said chassis.

10. A printer according to claim 9, wherein said printing table and said frame are capable of moving to a position beyond the position of said gripping means when the gripping means is located against said first stop means.

11. A printer according to claim 1, wherein said printing table and said frame are capable of moving to a position beyond the position of said gripping means when the gripping means is located against the first stop means.

12. A printer according to claim 1, wherein said first stop means comprises a movement-damping means having a precisely defined terminal position.

13. A printer according to claim 12, wherein said first stop means comprises a hydraulic damping device.

14. A printer according to claim 1, wherein a flexible element fixedly connects said gripping means to a gripping means attachment, said gripping means attachment having two end parts, each of said end parts being adapted to co-act with a respective first stop means, each of said first stop means comprising a movement-damping means.

15. A printer according to claim 14, wherein said gripping means attachment includes two rods extending therefrom, each of said rods being slidably movable within respective bushings which are mounted on mutually opposing parts of said frame, each of said rods being provided with second stop means which define a predetermined setting between the frame, the gripping means attachment and the gripping means.

16. A printer according to claim 14, further comprising means for lowering a forwardly located end part of said gripping means as said gripping means is moved towards said first stop means.

17. A printer according to claim 16, further comprising a spring attached to said gripping means and adapted to urge said gripping means upward so that said gripping means is substantially horizontally positioned, said means for lowering the forwardly located end of said gripping means comprising a guide roller extending from said gripping means and being pressed against a curved surface, said guide roller moving along said curved surface in response to movement of said gripping means and acting against the force of said spring which is attached to said gripping means, thereby facilitating engagement of the forwardly located end of the gripping means with the material to receive print.

18. A printer according to claim 1, wherein said first stop means is fixed in relation to a guide beam which is mounted on a chassis.

19. A printer according to claim 1, further comprising means for lowering a forwardly located end part of said gripping means as said gripping means is moved towards said first stop means.

20. A printer according to claim 19, further comprising a spring attached to said gripping means and adapted to urge said gripping means upward so that said gripping means is substantially horizontally positioned, said means for lowering the forwardly located end of said gripping means comprising a guide roller extending from said gripping means and being pressed against a curved surface, said guide roller moving along said curved surface in response to movement of said gripping means and acting against the force of said spring which is attached to said gripping means, thereby facilitating engagement of the forwardly located end of the gripping means with the material to receive print.

* * * * *